US007297881B2

(12) United States Patent
Yamasaki

(10) Patent No.: US 7,297,881 B2
(45) Date of Patent: Nov. 20, 2007

(54) COMPOSITE SWITCH

(75) Inventor: Masato Yamasaki, Okayama (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 11/634,114

(22) Filed: Dec. 6, 2006

(65) Prior Publication Data

US 2007/0131531 A1 Jun. 14, 2007

(30) Foreign Application Priority Data

Dec. 9, 2005 (JP) ..... 2005-355838

(51) Int. Cl.
*H01H 9/00* (2006.01)

(52) U.S. Cl. ..... 200/4; 200/5 R; 200/6 R; 200/553

(58) Field of Classification Search ..... 200/4
See application file for complete search history.

(56) References Cited

U.S. PATENT DOCUMENTS 5,623,134 A * 4/1997 Hayakawa ..... 200/5 R
5,719,361 A * 2/1998 Lee ..... 200/1 B
6,703,571 B2 * 3/2004 Nishimoto et al. ..... 200/6 A
7,109,428 B2 * 9/2006 Galvin et al. ..... 200/5 R

FOREIGN PATENT DOCUMENTS

JP 2002-203460 A 7/2002

* cited by examiner

*Primary Examiner*—Elvin Enad
*Assistant Examiner*—Lheiren Mae A. Anglo
(74) *Attorney, Agent, or Firm*—McDermott Will & Emery LLP

(57) ABSTRACT

A composite switch having a configuration in which: on the upper part of movable contacts of a first switch to a fourth switch disposed in a case, two driving bodies made of an inelastic insulating material such as polyamide are mounted in parallel to a swing center shaft; an upper surface of the case is covered with a cover having two long holes from which upper parts of the two driving bodies protrude; and the two driving bodies are pressed by an operation body, made of an inelastic insulating resin, which is swingably supported. With a composite switch having this configuration, an operation stroke is short and the generation of noise can be suppressed.

5 Claims, 9 Drawing Sheets

COMPOSITE SWITCH

BACKGROUND OF THE INVENTION

1. Field of the Invention

The present invention relates to a composite switch that is used mainly in an input operation section, and the like, of a mobile communication device such as a portable telephone and a pager, and various kinds of small-sized and multi-functional electronic devices such as a remote control, an audio device, a game device, a car navigation system, and a digital camera, and operates in two stages by tilting operation of an operation section.

2. Background Art

A conventional composite switch operating in two stages by tilting operation is described in FIG. 11 to FIG. 14.

FIG. 11 is an external perspective view showing a conventional composite switch. FIG. 12 an exploded perspective view showing a conventional composite switch. FIG. 13 is a sectional view taken along line 13-13 of FIG. 11. FIG. 14 is a sectional view taken along line 14-14 of FIG. 11.

In FIGS. 11 to 14, box-like case 1, made of an insulating resin, has a square shape seen from the upper surface. In case 1, first push switch 2 to fourth push switch 5 (hereinafter, referred to as first switch 2 to fourth switch 5) are disposed in the vicinities of the four corners on the bottom surface. Furthermore, support holes 1A for swingably supporting the below-mentioned operation body 7 are respectively provided in the centers of the walls of the two opposing sides.

Fixed contact 8 includes peripheral contact 8A and central contact 8B. Fixed contact 9 includes peripheral contact 9A and central contact 9B. Fixed contact 10 includes peripheral contact 10A central contact 10B. Fixed contact 11 includes peripheral contact 11A and central contact 11B. Fixed contacts 8 to 11 are insert-molded and fixed in four recessed portions. The four recessed portions are provided two by two symmetrically with respect to a line, which is a swing center shaft of operation body 7, connecting two support holes 1A of case 1. Furthermore, the peripheral portions of the lower surfaces of circular dome-like movable contacts 2A, 3A, 4A, and 5A made of an elastic metal thin plate are brought into contact with peripheral contacts 8A, 9A, 10A and 11A, respectively. The central portions of the lower surfaces of movable contacts 2A, 3A, 4A, and 5A face central contacts 8B, 9B, 10B and 11B, respectively.

In such a configuration, contact portions of first switch 2 to fourth switch 5 are turned ON when they are pressed from the upper part of operation body 7 and turned OFF when pressing is removed.

Note here that the above-mentioned four movable contacts 2A to 5A have the same diameters and heights. However, the thickness of an elastic metal thin plate as a material is larger in movable contacts 4A and 5A at the left side (see, for example, FIG. 11) than in movable contacts 2A and 3A at the right side (see, for example, FIG. 11). Therefore, the operation force at the time of being pressed is larger in movable contacts 4A and 5A than in movable contacts 2A and 3A.

On the upper parts of movable contacts 2A to 5A of the contact portions of first switch 2 to fourth switch 5, driving bodies 2B to 5B, made of an elastic insulating material such as rubber, are mounted. When movable contacts 2A to 5A of the contact portions are pressed via driving bodies 2B to 5B, first switch 2 to fourth switch 5 operate in a large pressing operation stroke.

Furthermore, driving bodies 2B to 5B are disposed in a manner in which two each of the driving bodies symmetric with respect to the swing center shaft of case 1, that is, driving bodies 2B and 3B and driving bodies 4B and 5B are connected and integrated with each other. Thus, connected driving bodies 12 and 13 are formed of the same elastic insulating material and having the same shape and dimension. Each of driving bodies 2B to 5B can be elastically deformed independently.

Then, the upper surface of case 1 housing switches 2 to 5 is covered with metal cover 16 having four holes 16A into which the upper parts of driving bodies 2B to 5B are inserted. Above cover 16, operation body 7 made of an insulating resin is placed.

Two columnar portions 7B are inserted into two support holes 1A of case 1. Columnar portions 7B are provided on the lower parts of the opposing two sides of plate portion 7A having a square shape seen from the upper surface of operation body 7. Operation body 7 is swingably supported around a line connecting two support holes 1A as a swing center shaft. Spherical shaped top parts of four driving bodies 2B and 5B are brought into contact with the lower surface of plate portion 7A of operation body 7, respectively.

Next, an operation of a conventional composite switch configured as mentioned above is described.

In a normal state, any contact portions of first switch 2 to fourth switch 5 of the composite switch are in an OFF state.

In this state, a force for tilting operation body 7 in the front down direction is applied as shown in FIG. 11. Then, operation body 7 swings around a line, connecting two columnar portions 7B at the lower part of operation body 7 supported by two support holes 1A of case 1, as a center shaft, and tilts in the front down direction. As operation body 7 moves in the front down direction, each of the spherical-shaped top ends of driving bodies 2B and 4B, which are brought into contact with the front side lower surface of plate portion 7A, is depressed. Driving bodies 2B and 4B themselves are compressed and deformed, and at the same time, they depress movable contacts 2A and 4A of first switch 2 and third switch 4 disposed in the lower part.

However, as mentioned above, the thickness of an elastic metal thin plate forming movable contact 4A is larger than that forming movable contact 2A. Therefore, when the tilting amount of operation body 7 is larger than a predetermined value, firstly, a dome-like portion of movable contact 2A elastically bends with comfortableness. Thus, peripheral contact 8A and central contact 8B of fixed contact 8 are short-circuited via movable contact 2A.

Thus, first switch 2 is operated and its signal is transmitted to a circuit of an electronic device using this composite switch via a leading terminal (not shown) connected to each contact. At this time, as mentioned above, the operation force of movable contact 4A of third switch 4 is larger than that of movable contact 2A of first switch 2 since the thickness of material of the operation force of movable contact 4A of third switch 4 is larger than that of movable contact 2A of third switch 2. At this time, only first switch 2 having a small operation force of movable contact 2A to be bent is operated and third switch 4 is not operated.

When the force applied to operation body 7 is increased from this state, the top ends of driving bodies 2B and 4B are further depressed and driving body 2B of first switch 2 is compressed and deformed in a state in which movable contact 2A is pressed onto central contact 8B. Driving body 4B of third switch 4 is also further compressed and deformed. When the amount becomes a predetermined amount or more, and the pressing force toward movable contact 4A is beyond the operation force for bending movable contact 4A, movable contact 4A elastically bends with comfortableness. Peripheral contact 10A and central contact 10B of fixed contact 10 are short-circuited via movable contact 4A. Thus, third switch 4 is operated.

Then, when the force applied to operation body 7 is removed, in the reverse order with respect to that of the pressing operation, movable contacts 2A and 4A and driving bodies 2B and 4B restore the original shape by the restoring force. That is to say, operation body 7 is returned to the original position and first switch 2 and third switch 4 are returned to the original normal state, that is, an OFF state again.

Similarly, when a force for tilting operation body 7 in the rear down direction is applied, second switch 3 firstly operates. When the pressing force is further increased, fourth switch 5 also operates. When this pressing force is removed, fourth switch 5 and second switch 3 are turned OFF in the reverse order with respect to the above-mentioned order.

As mentioned above, by tilting operation body 7, the composite switch can operate first switch 2 and third switch 4 or second switch 3 and fourth switch 5 in two stages with different operation strokes and operation forces.

An example of prior art information related to the invention of this application includes Japanese Patent Unexamined Publication No. 2002-203460.

However, in accordance with recent diversification of various electronic devices, switches having a short tilting operation stroke or generating less operation click at the time of operation have been demanded. However, in the above-mentioned conventional composite switch, since driving bodies 2B to 5B are formed of an elastic insulating material such as rubber, there is limitation to shortening the tilting operation stroke. Furthermore, as mentioned above, when an elastic insulating material is used, sound generated when movable contacts 2A to 5A elastically bend is large, thus making it difficult to suppress the generation of noise.

SUMMARY OF THE INVENTION

The present invention provides a composite switch in which an operation stroke is short and the generation of noise is suppressed.

The present invention relates to a composite switch including an operation body, made of an inelastic material, having a square shape seen from an upper surface and being swingably supported by a case around a middle point between two opposing sides as a fulcrum; two pairs of push switches disposed at a lower side in both tilting directions at the time of tilting of the operation body in a manner in which the push switches are disposed two by two symmetrically with respect to a line that is a swing center shaft of the case, wherein the two push switches in one of the pairs at one side have different operation forces; two driving bodies, made of an inelastic material, disposed in contact with each upper surface of one pair of push switches located in parallel to the swing center shaft of the case; and a cover allowing the two driving bodies to be housed in and fixed to the case and having windows from which upper parts of the two driving bodies protrude. When the operation body is tilted in one direction, an upper surface position of the driving body that is a center between the one pair of push switches at a lower side in the tilting direction is pressed and the one pair of push switches operate by different operation forces.

When the operation body and the driving body are formed of an inelastic material, it is possible to realize a composite switch in which a tilting operation stroke is short, and noise generated when movable contact bends is small, that is, the generation of noise is suppressed.

Furthermore, according to the present invention, the two pairs of push switches have a circular shape and are disposed in a manner in which they are displaced from each other in a range of the one pair of push switches in a direction parallel to the swing center shaft of the case. Such a configuration can reduce the outer size in the tilting direction of the composite switch and contribute to miniaturization of various electronic devices.

Furthermore, according to the present invention, the two pairs of push switches are operated by a same operation force and a contact position of the operation body pressing an upper surface of the driving body at the time of tilting operation is a position displaced from the center between the pair of push switches at a lower side in the tilting direction. With such a configuration, it is possible to realize a composite switch capable of operating in two stages by tilting operation of an operation body by using push switches having the same operation force. Thus, excellent productivity can be achieved.

Furthermore, according to the present invention, a portion that is brought into contact with the driving body at the time of tilting of the operation body has a spherical protruding shape. With such a configuration, the rotation operation of the operation body at the time of tilting operation can be converted into the operation in the vertical direction of the driving body smoothly so as to be transmitted. Therefore, a composite switch that is excellent in operation property can be realized.

In addition, according to the present invention, the operation body is always brought into contact with the two driving bodies in a normal state in which the operation body is not tilted. With such a configuration, wobble in the operation body and driving body can be suppressed and the quality when an operating knob at the side of an electronic device is installed to the operation body is improved.

DETAILED DESCRIPTION OF THE INVENTION

Hereinafter, an embodiment of the present invention is described with reference to FIGS. 1 to 10.

EMBODIMENT

Figure 1:
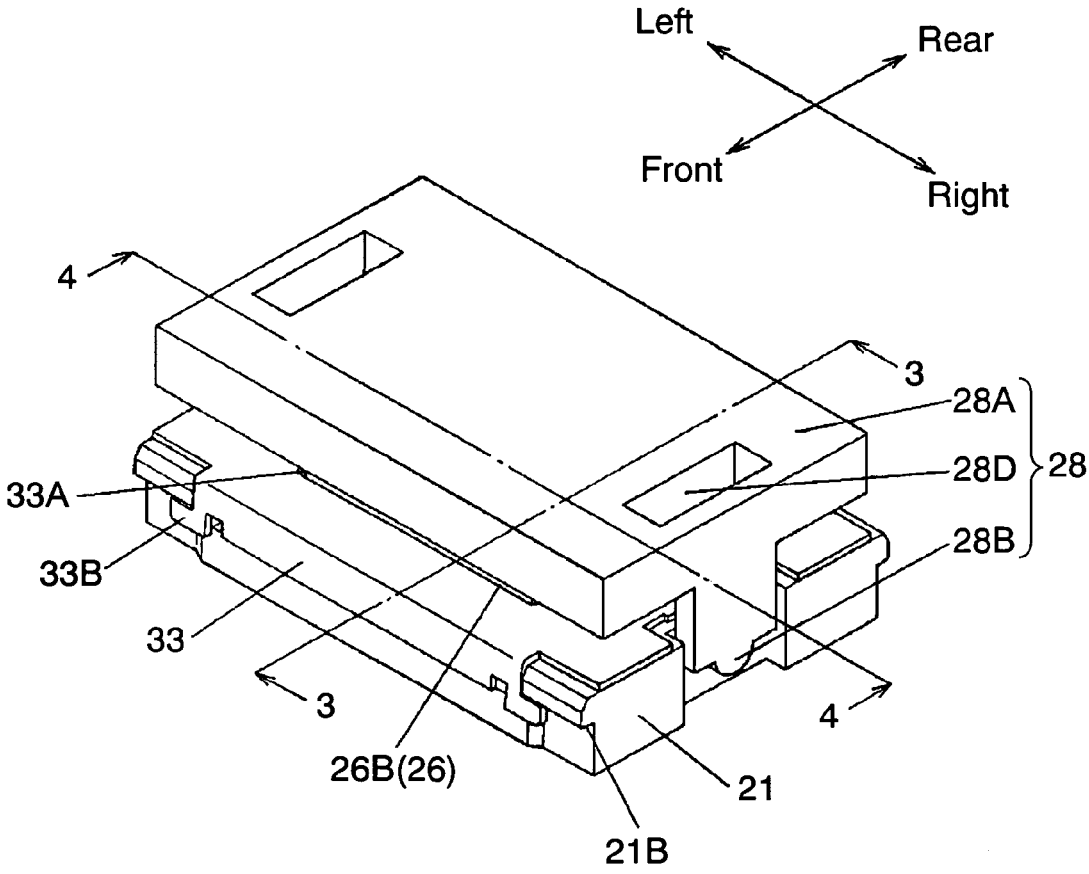
FIG. 1 is an external perspective view showing a composite switch in accordance with an embodiment of the present invention.
Figure 2:
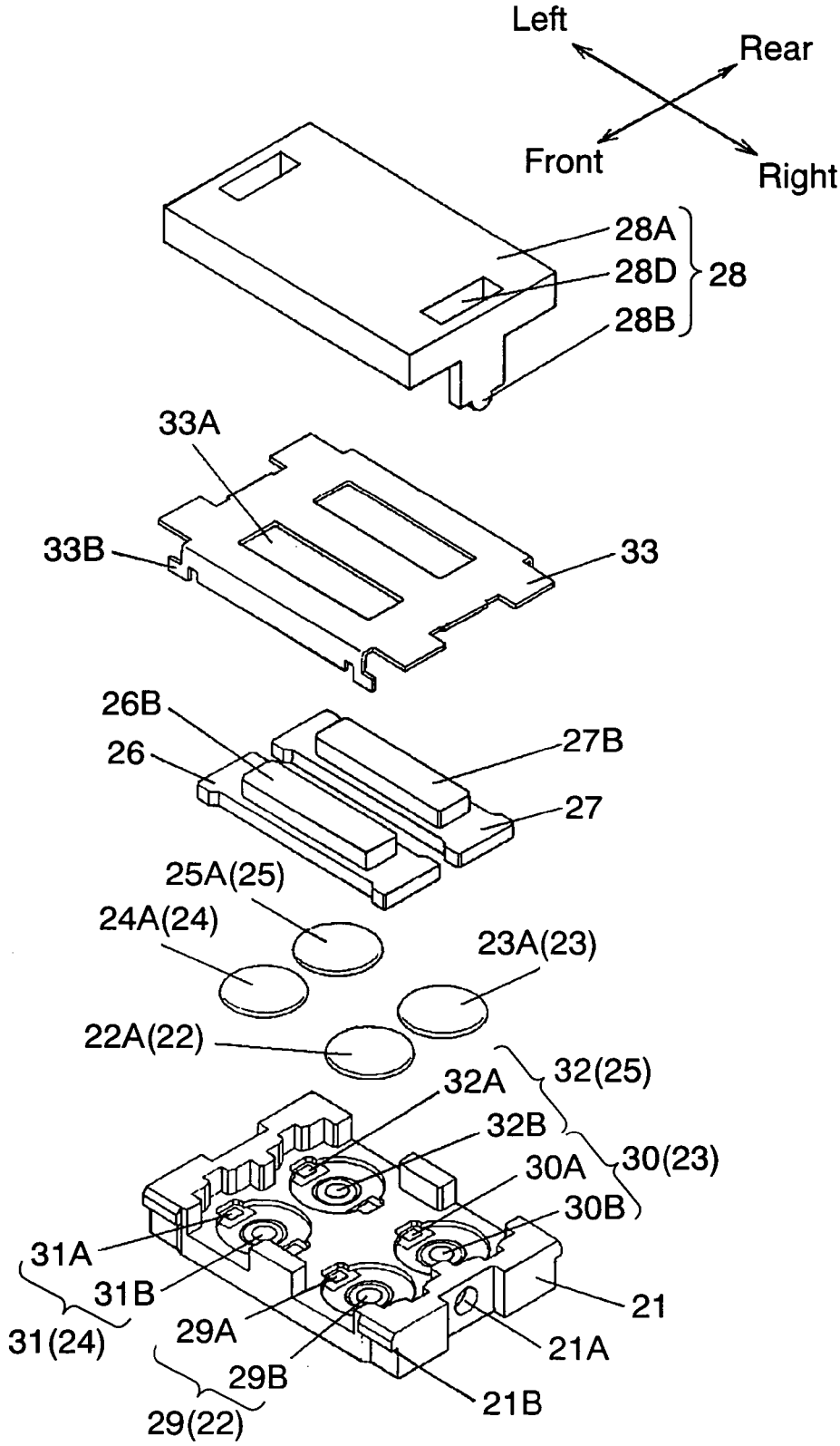
FIG. 2 is an exploded perspective view showing a composite switch in accordance with an embodiment of the present invention.
Figure 3:
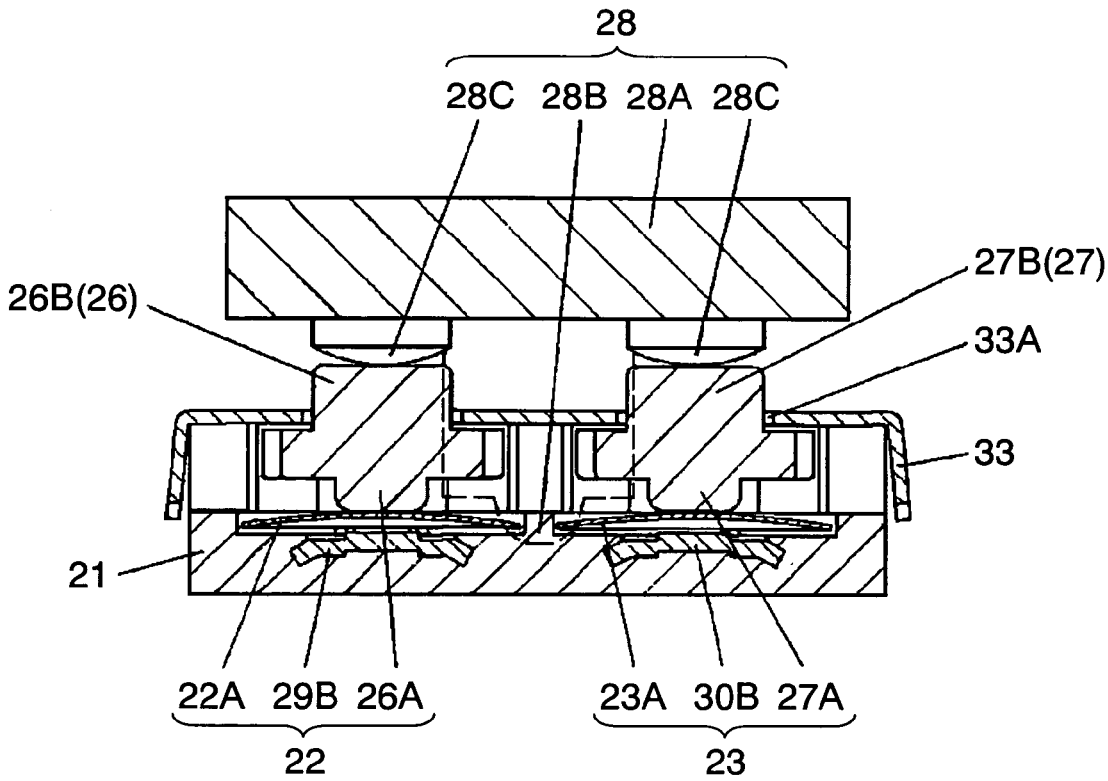
FIG. 3 is a sectional view taken along line 3-3 of FIG. 1.
Figure 4:
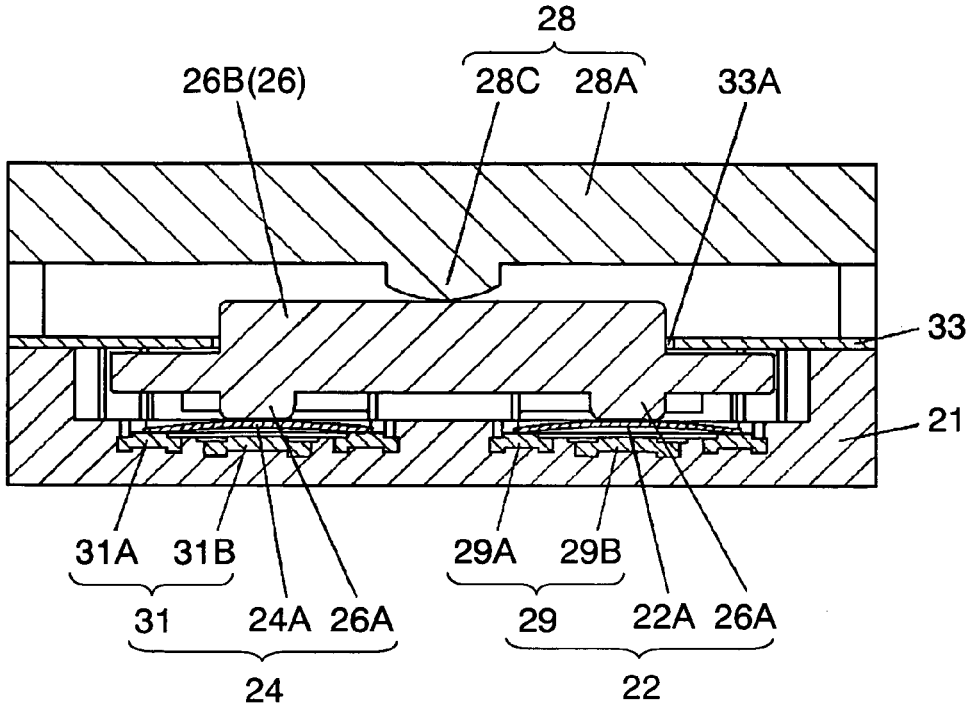
FIG. 4 is a sectional view taken along line 4-4 of FIG. 1.
Figure 5:
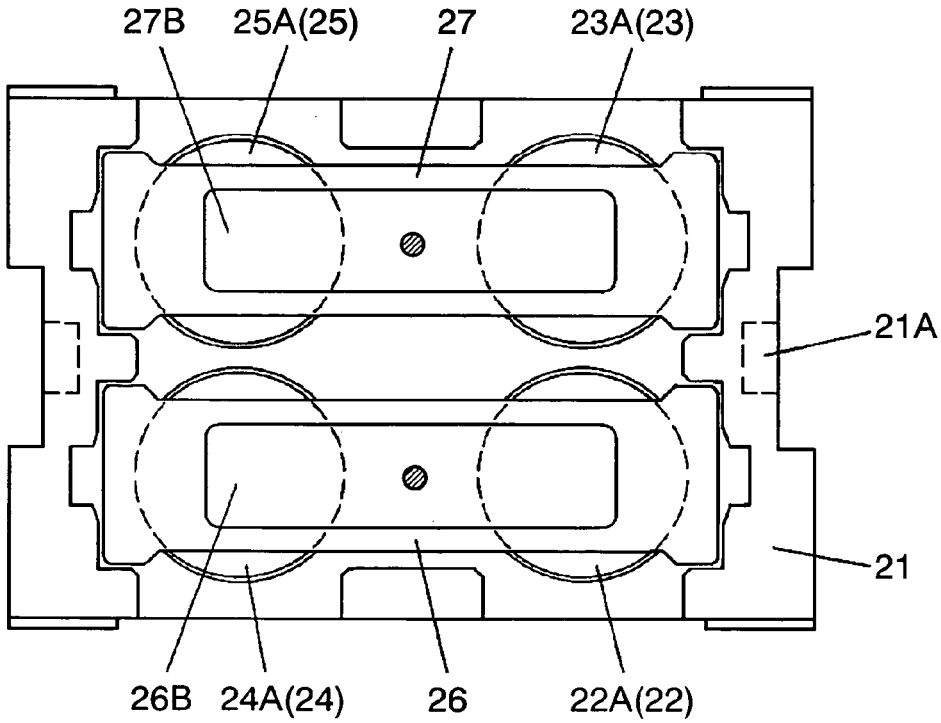
FIG. 5 is a plan view with an operation body and a cover being removed.
Figure 6:
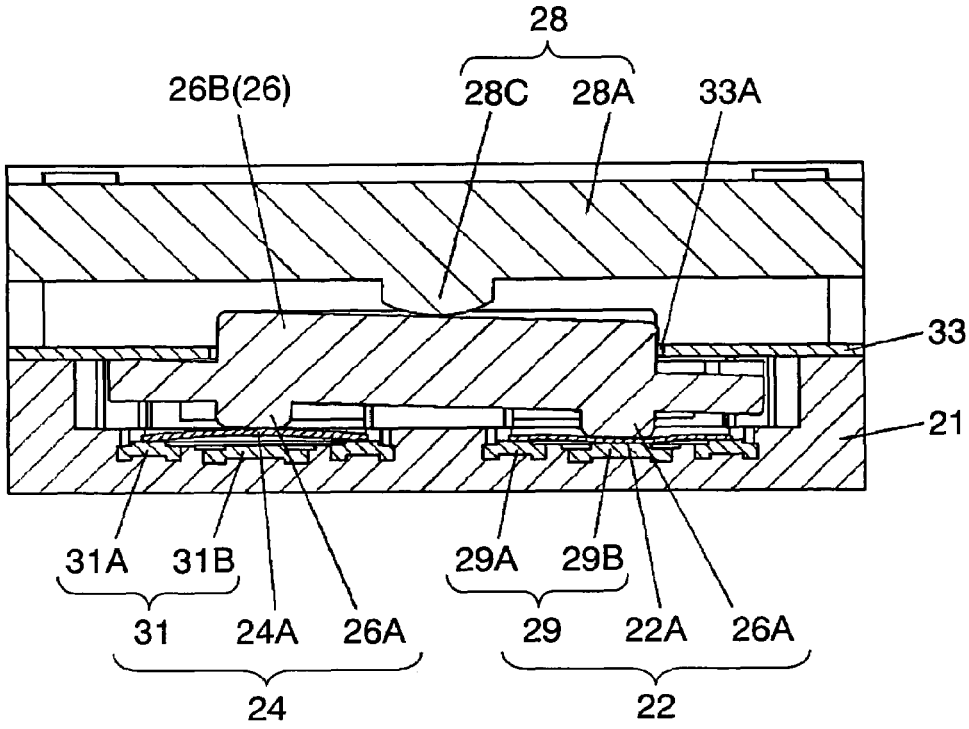
FIG. 6 is a sectional view to illustrate an operation state of FIG. 4.
Figure 7:
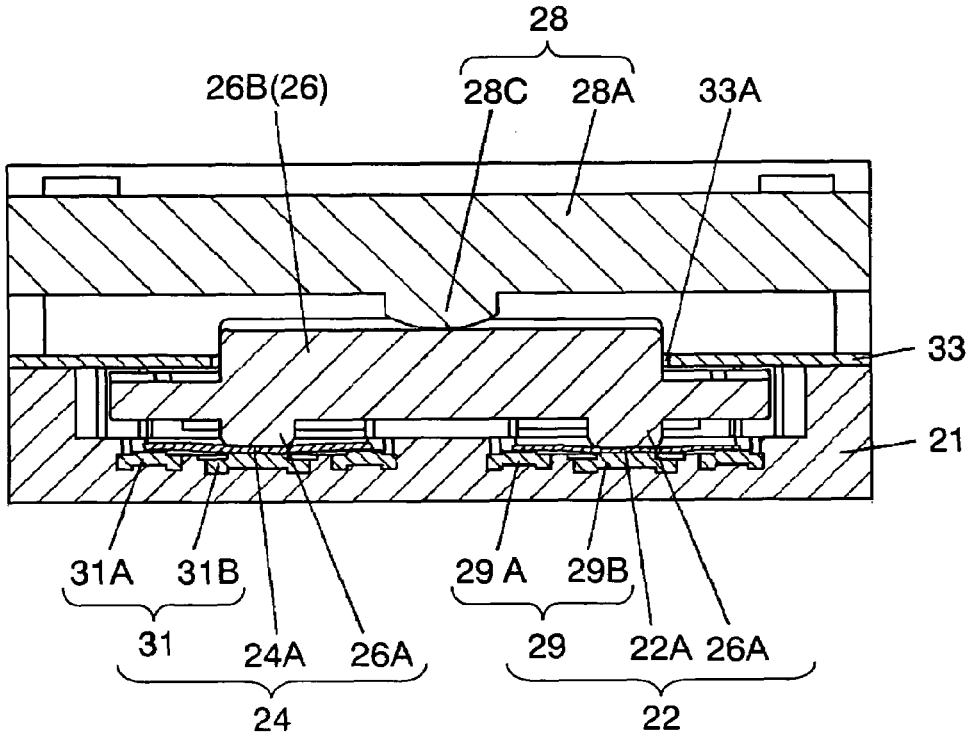
FIG. 7 is a sectional view to illustrate an operation state of FIG. 4.
Figure 8:
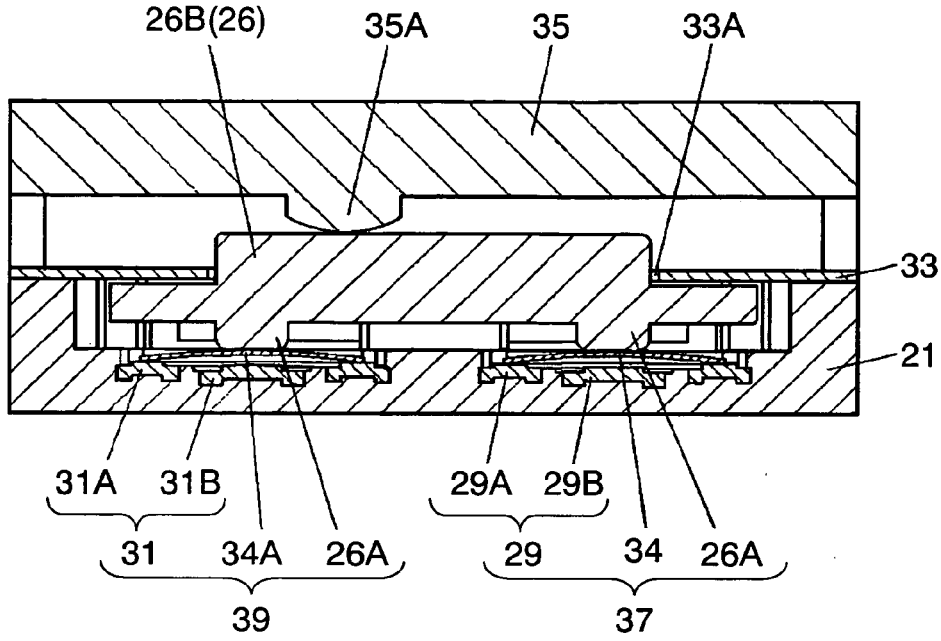
FIG. 8 is a sectional view showing another embodiment in which a movable contact and an operation body are changed.
Figure 9:
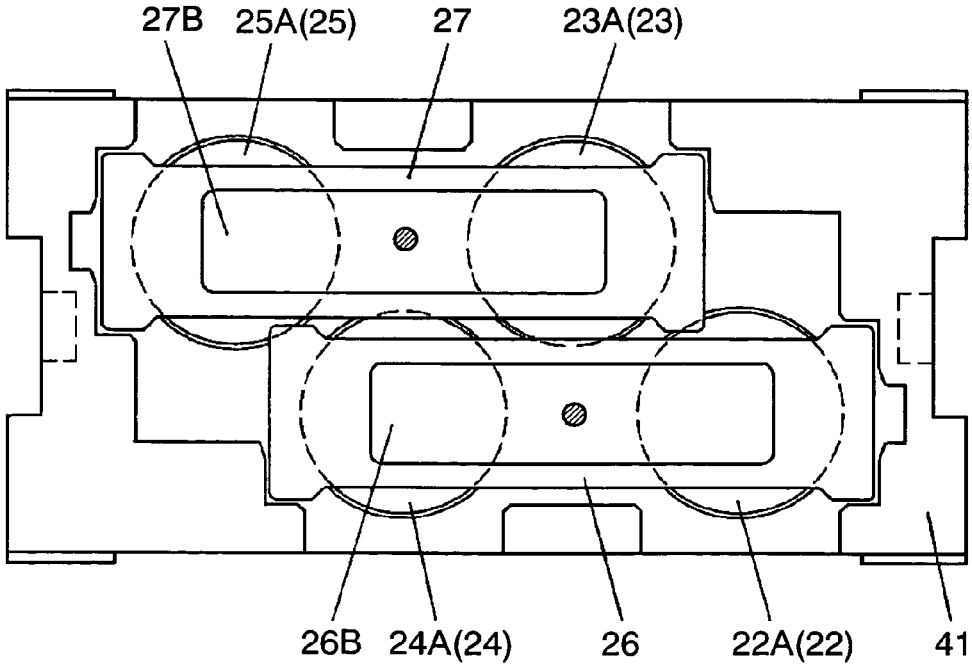
FIG. 9 is a plan view showing another embodiment with an operation body and a cover being removed.

FIG. 1 is an external perspective view showing a composite switch in accordance with an embodiment of the present invention. FIG. 2 is an exploded perspective view showing a composite switch in accordance with an embodiment of the present invention. FIG. 3 is a sectional view taken along line 3-3 of FIG. 1. FIG. 4 is a sectional view taken along line 4-4 of FIG. 1. FIG. 5 is a plan view with an operation body and a cover being removed. FIG. 6 is a sectional view to illustrate an operation state of FIG. 4. FIG. 7 is a sectional view to illustrate an operation state of FIG. 4. FIG. 8 is a sectional view showing another embodiment in which a movable contact and an operation body are changed. FIG. 9 is a plan view showing another embodiment with an operation body and a cover being removed.

In FIGS. 1 and 2, case 21, made of an insulating resin, has a box-like shape that is square seen from the upper surface. In the vicinities of four corners on the bottom surface of case 21, circular first switch 22 to fourth switch 25 are disposed. In the centers of the walls of the two opposing sides, support holes 21A for swingably supporting the below-mentioned operation body 28 are provided, respectively.

Peripheral contacts 29A to 32A and central contacts 29B to 32B are insert-molded and fixed in four recessed portions. The recessed portions are provided two by two in positions symmetric with respect to a line, which is a swing center shaft of operation body 28, connecting two support holes 21A. Fixed contacts 29 to 32 are configured by pairs of peripheral contacts 29A to 32A and central contacts 29B and 32B, respectively. Furthermore, on peripheral contacts 29A to 32A, circular dome-like movable contacts 22A to 25A made of an elastic metal thin plate are mounted in a state in which the peripheral lower ends thereof are brought into contact with 29A to 32A. Contact portions of circular first switch 22 to fourth switch 25 are configured in which the centers of the lower surfaces of movable contacts 22A to 25A face central contacts 29B to 32B, respectively.

When the centers of movable contacts 22A to 25A are pressed from the upper part, the dome-like portions elastically bend and the centers of the lower surface are brought into contact with central contacts 29B to 32B so as to be turned ON. When the pressing force is removed, the dome-like portions of movable contacts 22A to 25A restore the original shape by the restoring force so as to be turned OFF.

Furthermore, the above-mentioned four movable contacts 22A to 25A have the same diameter and height. However, an elastic metal thin plate as a material has a larger thickness in movable contacts 24A and 25A, located at the left side (see, for example, FIG. 1), i.e., at one side with respect to the swing center shaft, than in rest movable contacts 22A and 23A. The operation force at the time of being pressed is larger in movable contacts 24A and 25A.

On the upper part of movable contacts 22A and 24A of a pair of first and third switches 22 and 24 at the front side, driving body 26 having a rectangular shape seen from the upper surface is mounted in such a manner as to be parallel to the swing center shaft. Similarly, also on the upper part of movable contacts 23A and 25A of a pair of second and fourth switches 23 and 25 at the rear side, driving body 27 having a rectangular shape seen from the upper surface is mounted in such a manner as to be parallel to the swing center shaft.

Driving body 26 at the front side has two pressing portions 26A, the lower end of which has a spherical surface and which protrude from the lower surface of driving body 26. Two pressing portion 26A are brought into contact with the upper surfaces of the center of movable contacts 22A and 24A. At the same time, driving body 27 at the rear side has two pressing portions 27A, the lower end of which has a spherical surface and which protrude from the lower surface of driving body 27. Two pressing portion 27A are brought into contact with the upper surfaces of the centers of movable contacts 23A and 25A. That is to say, driving bodies 26 and 27 are placed in a state in which they keep symmetrical position parallel to the swing center shaft. Movable contacts 22A and 24A of first switch 22 and third switch 24 are pressed by driving body 26. Movable contacts 23A and 25A of second switch 23 and fourth switch 25 are pressed by driving body 27. Thus, first switch 22 to fourth switch 25 can be operated.

The upper surface of case 21 housing first switch 22 to fourth switch 25 is covered with cover 33 made of a metal plate. Cover 33 has two long holes 33A. From respective holes 33A, upper protruding portions 26B and 27B of driving bodies 26 and 27 having a rectangular shape seen from the upper surface protrude. Furthermore, cover 33 is fixed to case 21 in a manner in which L-shaped locking portions 33B, which are provided in the corners of a pair of opposing side surfaces folded downward, are locked on the lower positions of side surface protruding portion 21B of case 21.

Operation body 28 made of an inelastic insulating resin has plate portion 28A having substantially a square shape seen from the upper surface and two columnar portions 28B provided on the lower part of two opposing sides thereof. Two columnar portions 28B are inserted into two support holes 21A of case 21. Operation body 28 is swingably supported around a line connecting two support holes 21A as a swing center shaft.

Plate portion 28A of operation body 28 has engaging holes 28D in which an operating knob of an electronic device (not shown) is placed. On the lower surface of plate portion 28A, two spherical protruding portions 28C each having a spherical-shaped lower end are provided corresponding to each of driving bodies 26 and 27.

Two spherical protruding portions 28C are brought into contact with the upper surfaces of upper protruding portions 26B and 27B of driving bodies 26 and 27, respectively. The contact portions are shown by black circle in FIG. 5. Two spherical protruding portions 28C are disposed corresponding to the center between two pressing portions 26A of front side driving body 26 and to the center between two pressing portions 27A of rear side driving body 27, respectively.

In accordance with recent demands for small and thin devices, electronic components to be reflow mounted on a wiring board of a device have been used more frequently. The composite switch may be also a switch corresponding to reflow mounting. In this case, for example, driving bodies 26 and 27 and operation body 28 may be formed of an inelastic material such as polyamide, a liquid crystal polymer, and the like, and case 21 may be formed of PPA (polyphthalamide), and the like.

Next, an operation of the composite switch is described.

Firstly, in a normal state in which a pressing force is not applied to operation body 28, two spherical protruding portions 28C of operation body 28 are brought into contact with the upper surfaces of upper protruding portions 26B and 27B of driving bodies 26 and 27. First switch 22 to fourth switch 25 in which pressing portions 26A and 27A on the lower surfaces of driving bodies 26 and 27 are brought into contact with movable contacts 22A to 25A are in an OFF state.

From the above-mentioned normal state, when a force for tilting operation body 28 in the front down direction shown in FIG. 1 is applied, operation body 28 swings around a line connecting two columnar portions 28B provided at both ends of operation body 28 supported by two support holes 21A of case 21, and tilts in the front down direction. Then, with the tilting operation, the pressing force is applied to driving body 26 that is brought into contact with spherical protruding portion 28C at the front side of operation body 28, and the centers of the upper surfaces of movable contacts 22A and 24A of first switch 22 and third switch 24 with which pressing portion 26A located at the lower surface of driving body 26 are brought into contact.

When a tilting operation angle of operation body 28 is increased and the pressing force to the above-mentioned movable contacts 22A and 24A is beyond a predetermined elastic deformation force, as shown in FIG. 6, firstly, the dome-like portion of movable contact 22A of first switch 22 whose elastic metal thin plate as a material is thin bends with comfortableness and light operation click. Then, the center of the lower surface of movable contact 22A is brought into contact with central contact 29B. Thus, peripheral contacts 29A and central contact 29B are short-circuited via movable contact 22A, and first switch 22 is turned ON. A signal passing through first switch 22 is transmitted to a circuit of an electronic device using this composite switch via a lead terminal (not shown) connected to each contact. At this time, movable contact 24A of third switch 24 does not yet bend and driving body 26 is in a tilting state in which the side of movable contact 22A is somewhat lower.

From the state, when the force applied to operation body 28 is further increased so as to increase the pressing force to driving body 26 in spherical protruding portion 28C of the front side of operation body 28, as shown in FIG. 7, the dome-like portion of movable contact 24A of third switch 24 bends with comfotableness and light operation click. Thus, the center of the lower surface of movable contact 24A is brought into contact with central contact 31B so as to establish continuity between peripheral contact 31A and central contact 31B. Thus, third switch 24 is also turned ON in addition to first switch 22.

Thus, in accordance with this embodiment, since driving body 26 and operation body 28 are made of an inelastic insulating resin, driving body 26 and operation body 28 themselves do not elastically shrink. As a result, a tilting operation stroke before first switch 22 starts to operate and a tilting operation stroke before third switch 24 starts to operate can be shortened. Furthermore, light operation click generated when movable contacts 22A and 24A bend is kept small, and the generation of noise can be suppressed.

When the tilting pressing force applied to operation body 28 is removed, in the reverse order with respect to the order at the time of tilting operation, firstly, movable contact 24A restores the original dome shape by its restoring force with comfortableness and light operation click, and driving body 26 is pushed back to the upper part. Then, movable contact 22A restores the original dome shape by its restoring force with comfortableness and light operation click, and driving body 26 is pushed back to the upper part. With these sequential operation, operation body 28 is returned to the original position, so that first switch 22 and third switch 24 are turned to an OFF state, that is, a normal state as shown in FIG. 4. Also in the series of restoring operations, movable contacts 22A and 24A do not make light operation click, and thus the generation of noise can be suppressed.

On the contrary, when a force for tilting operation body 28 in the rear down direction is applied, operation body 28 tilts in the rear down direction around the swing center shaft as a center. Driving body 27 with which spherical protruding portion 28C of the rear side of operation body 28 is brought into contact is depressed, so that a pressing force is applied to the center of the upper part of movable contacts 23A and 25A of second switch 23 and fourth switch 25 with which pressing portion 27A on the lower surface of driving body 27 is brought into contact.

When the pressing force to the above-mentioned movable contacts 23A and 25A is beyond a predetermined elastic deformation force, firstly, movable contact 23A of first switch 23 bends with comfortableness and light operation click. Then, continuity between peripheral contact 30A and central contact 30B is established via movable contact 23A, and second switch 23 is turned ON.

Furthermore, movable contact 25A of fourth switch 25 bends with comfortableness and light operation click. Then, continuity between peripheral contact 32A and central contact 32B is established via movable contact 25A, and fourth switch 25 is turned ON in addition to first switch 23.

When the tilting pressing force applied to operation body 28 is removed, in the reverse order with respect to the above-mentioned order, firstly, movable contact 25A restores the original shape by its restoring force with comfortableness and light operation click. Subsequently, movable contact 23A similarly restores the original shape by its restoring force with comfortableness and light operation click. Second switch 23 and fourth switch 25 are returned to an OFF state, and driving body 27 and operation body 28 are pushed back to the original position.

Thus, in the composite switch in accordance with the embodiment of the present invention, operation body 28 rotates and driving bodies 26 and 27 operate vertically. Since the lower end of operation body 28 that is brought into contact with upper protruding portions 26B and 27B of driving bodies 26 and 27 includes spherical protruding portion 28C, even if a tilting operation angle of operation body 28 is changing, the contact to driving body 26 or 27 is stable, so that the tilting operation of operation body 28 can be smoothly done. Therefore, driving body 26 carries out a vertical operation reliably. Furthermore, with such a configuration, even in a state in which driving body 26 or 27 tilts when a switch at one side is turned ON, spherical protruding portion 28C is brought into contact with upper protruding portion 26B or 27B stably. Thus, the following operation is carried out smoothly.

Furthermore, in the normal state in which a tilting force is not applied to operation body 28, spherical protruding portions 28C of operation body 28 are brought into contact with upper protruding portions 26B and 27B of two driving bodies 26 and 27, and pressing portions 26A and 27A of driving bodies 26 and 27 are brought into contact with the upper surfaces of the center of movable contacts 22A to 25A which are located below, respectively. Therefore, wobble in driving bodies 26 and 27 and operation body 28 can be suppressed, and the quality when an operating knob at the side of an electronic device to be used is placed on operation body 28 is improved.

Note here that the above-mentioned composite switch may have a configuration shown in FIG. 8.

In the composite switch shown in FIG. 8, an operation force with respect to four movable contacts 34 are the same. FIG. 8 is different from FIG. 4 in that spherical protruding portions 35A of operation body 35 for pressing driving bodies 26 and 27 are brought into contact with the positions that are displaced to one of the pressing portions from respective center portions between two pressing portions 26A and between two pressing portions 27A located at the lower surfaces of driving bodies 26 and 27, for example, a portion displaced to the left side in FIG. 8. The other configuration is the same as mentioned above and therefore the description therefor is omitted.

In FIG. 8, firstly, when a pressing force for tilting operation body 35 in the front direction is applied so as to be tilted, the force is applied to driving body 26 with which spherical protruding portion 35A on the lower surface of operation body 35 is brought into contact. At this time, spherical protruding portion 35A presses the position displaced to the left side from the center between two pressing portions 26A on the lower surface of driving body 26. As a result, a difference is generated in the pressing force pressed by driving body 26 between movable contact 34 located at the right side and movable contact 34 located at the left side. That is to say, a larger pressing force is applied to left movable contact 34 than to right movable contact 34. Therefore, firstly, left movable contact 34 elastically bends with comfortableness and light operation click, and third switch 39 is turned ON. When operation body 35 is further tilted, right movable contact 34 elastically bends with comfortableness and light operation click, and third switch 37 is also turned ON.

When the pressing force applied to operation body 35 is removed, in the reverse order with respect to the above-mentioned order, movable contact 34 sequentially restores the original dome shape and driving body 26 and the like is pushed back to the original position and first switch 37 and third switch 39 are returned to an OFF state, that is, a state shown in FIG. 8. An operation for tilting operation body 35 in the opposite side is the same, and so the description therefor is omitted.

Also in such a configuration, since driving body 26 is made of an inelastic insulating resin material, driving body 26 does not shrink at the time of operation and is depressed corresponding to the tilting operation. Therefore, an operation stroke is short. Furthermore, the generation of noise at the time of bending operation of movable contact 34 is suppressed. Furthermore, with such a configuration, movable contacts 34 for four push switches can be formed of one kind. Thus, the production efficiency can be improved.

The distance in which spherical protruding portion 35A of operation body 35 is displaced may be appropriately set by considering the difference between the operation force of a push switch to operate first and the pressing force to operate secondarily when a tilting operation is carried out.

Furthermore, a configuration shown in FIG. 9 may be employed.

FIG. 9 is a plan view showing a composite switch with an operation body and a cover being removed. Main difference between a configuration shown in FIG. 9 and the configuration mentioned above is in the arrangement of four switches. That is to say, two pairs of push switches are disposed in a staggered state and one pair of switches are displaced from the other pair in the parallel direction to the swing center shaft in which one switch of one pair is located between two switches of the other pair.

In the composite switch shown in FIG. 9, second switch 23 at the upper right side is located between third switch 24 at the lower left side and first switch 22 at the lower right side, which are located at the lower side and upper side with the swing center shaft connecting the centers of the left and right opposing sides sandwiched therebetween. Between fourth switch 25 at upper left side and second switch 23, third switch 24 is located.

Driving bodies 26 and 27 and an operation body made of an inelastic material as mentioned above and a cover are disposed corresponding to the positions in which two pairs of push switches 22 to 25 are disposed. Positions in which spherical protruding portions (not shown) of the operation body are brought into contact with upper protruding portions 26B and 27B of driving bodies 26 and 27 are positions shown by black circles in FIG. 9. The positions of the black circles are the centers between two pressing portions 26A and between pressing portions 27A, which are not shown, of driving bodies 26 and 27. Furthermore, in movable contacts 22A to 25A, as compared with movable contacts 22A and 23A, movable contacts 24A and 25A have a thicker elastic metal thin plate as a material and have a larger operation force.

When two pairs of push switches 22 to 25 are disposed in this configuration, as compared with the configuration mentioned with reference to FIGS. 1 to 7, case 41 can have a smaller size in the tilting direction perpendicular to the swing center shaft although the size of the swing center shaft becomes slightly longer. Therefore, this configuration is useful for cases where the mounting space is limited and can contribute to miniaturization of various electronic devices.

The operation state of the composite switch shown in FIG. 9 is the same as that described with reference to FIG. 1. Since driving bodies 26 and 27 are made of an inelastic insulating resin material, an operation stroke is short. Furthermore, when movable contacts 22A to 25A bend, comfortableness and light operation click are not generated, so that the generation of noise can be suppressed.

Figure 10:
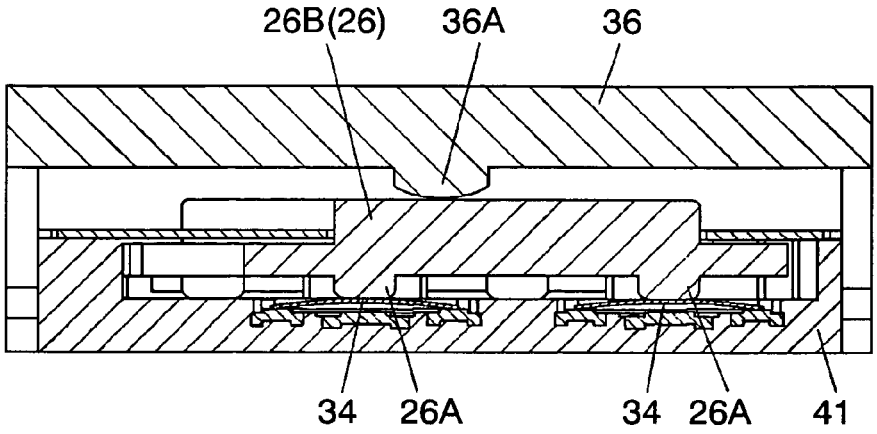
FIG. 10 is a sectional view showing another embodiment in which a -movable contact and an operation body are changed in FIG. 9.
Figure 11:
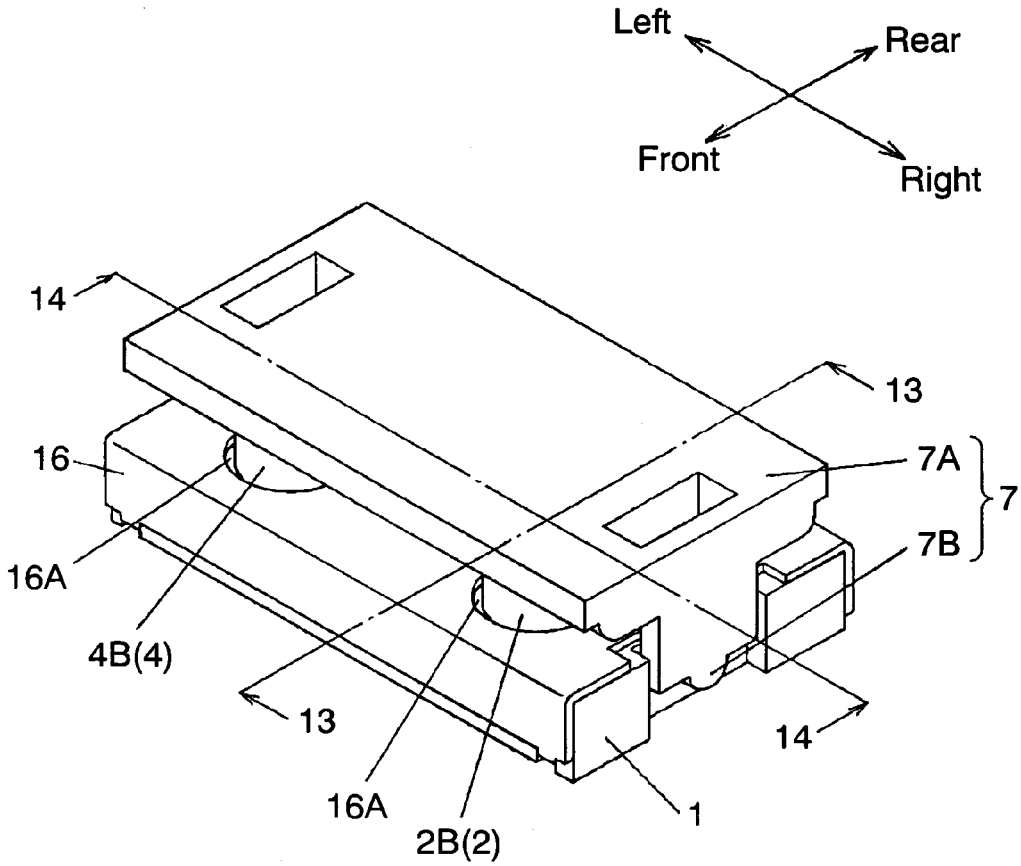
FIG. 11 Prior Art
FIG. 11 is an external perspective view showing a conventional composite switch.
Figure 12:
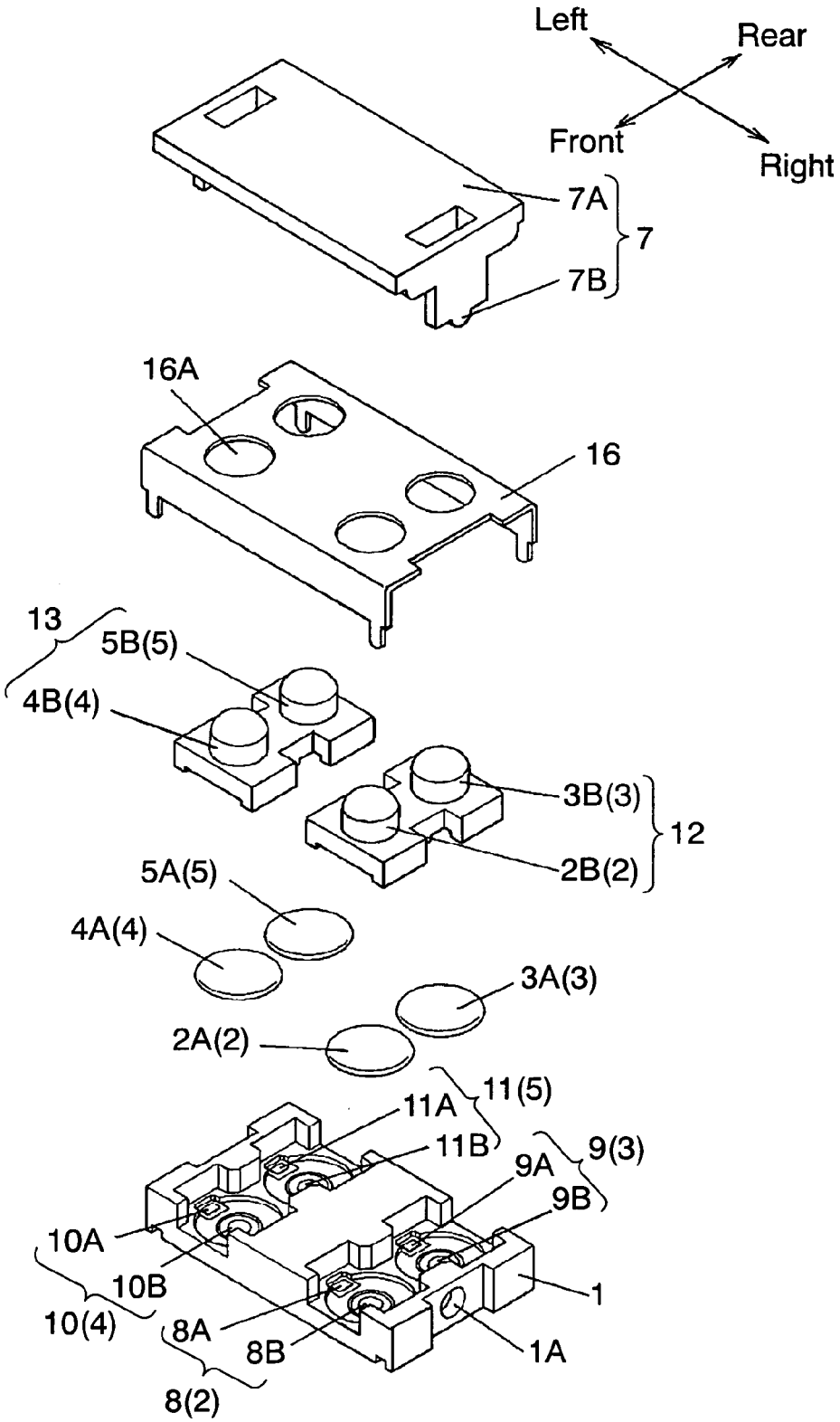
FIG. 12 Prior Art
FIG. 12 is an exploded perspective view showing a conventional composite switch.
Figure 13:
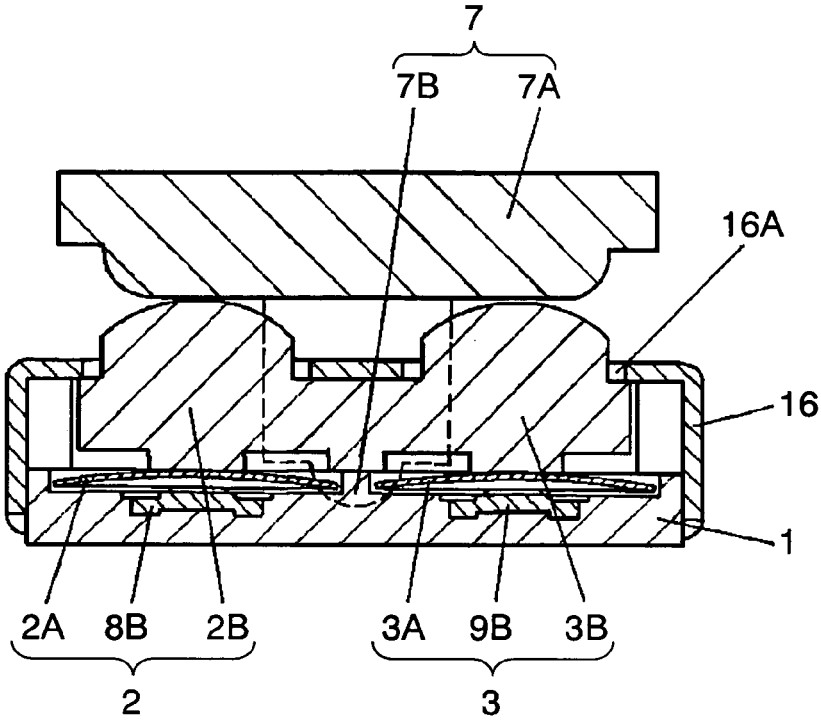
FIG. 13 Prior Art
FIG. 13 is a sectional view taken along line 13-13 of FIG. 11.
Figure 14:
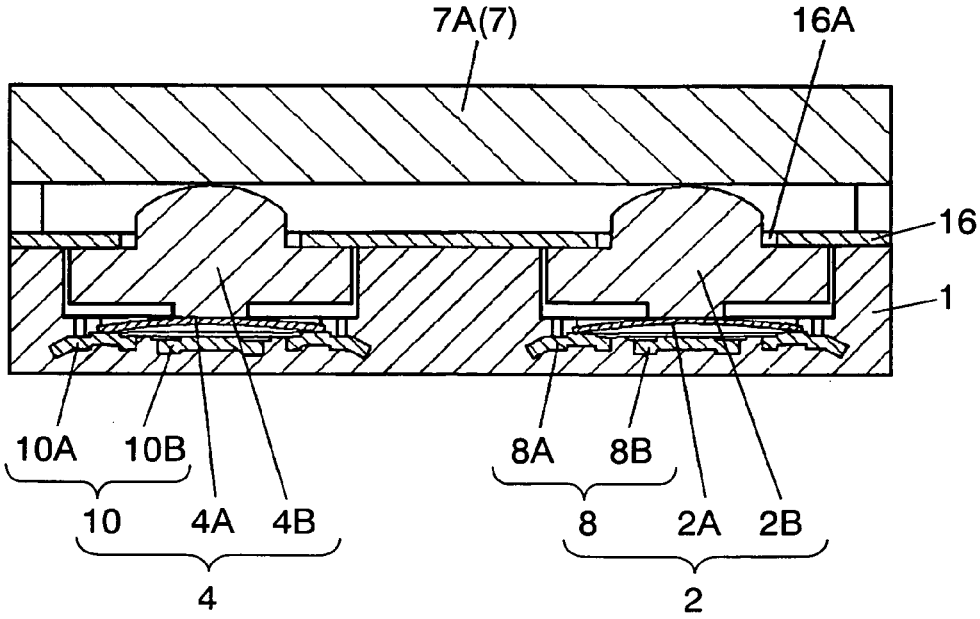
FIG. 14 Prior Art
FIG. 14 is a sectional view taken along line 14-14 of FIG. 11.

Furthermore, with respect to the configuration shown in FIG. 9, four movable contacts are allowed to have the same operation forces and may be combined with the configuration of FIG. 8. A composite switch having such a configuration is shown in a sectional view of FIG. 10. In FIG. 10, spherical protruding portion 36A of operation body 36 is brought into contact with driving body 26 in the position that is displaced from the center in the direction parallel to the swing center shaft between two pressing portions 26A. Although not shown, the side of driving body 27 also has the same configuration.

Since pressing protruding portions 36A at the lower surface of operation body 36 are provided on the lower surface of center between the left and right directions of case 41 but driving body 26 is disposed in the position displaced in the right direction of case 41, when operation body 36 is tilted to the front side in the drawing, spherical protruding portion 36A presses the position displaced to the left side from the center portion between two pressing portions 26A of driving body 26. Therefore, movable contacts 34 at the left side firstly bend with comfortableness and light operation click. When the pressing force is further applied, remaining pair of movable contacts 34 at the right side bend with comfortableness and light operation click.

When the pressing force for the tilting operation is removed, in the reverse order, two movable contacts 34 restore the original state by the restoring force so as to be returned to a state shown in FIG. 10. The operation for allowing operation body 36 to tilt in the opposite direction is the same as the operation mentioned above, the description therefor is omitted.

Thus, also with the embodiment of FIG. 10, movable contacts 34 of the four push switches are one kind, thus achieving the efficient production efficiency. Furthermore, driving bodies 26 and 27 made of an inelastic insulating resin material do not elastically shrink and are depressed corresponding to the tilting operation. Therefore, a tilting operation stroke can be short. Furthermore, the generation of noise at the time of bending operation of movable contact 34 can be reduced.

As described above, the composite switch in accordance with the present invention operates in two stages by a tilting operation. In the operation, the tilting operation stroke is short and the generation of noise at the time of bending operation of the movable contact is small. Therefore, the composite switch is useful in an input operation section, and the like, of a mobile communication device such as a portable telephone and a pager, and various kinds of small-sized and multifunctional electronic devices such as a remote control, an audio device, a game device, a car navigation system, and a digital camera.

What is claimed is:

1. A composite switch comprising:

an operation body, made of an inelastic material, having a square shape seen from an upper surface and being swingably supported by a case around a middle point between two opposing sides as a fulcrum;

two pairs of push switches disposed at a lower side in both tilting directions at the time of tilting of the operation body in a manner in which the push switches are disposed two by two symmetrically with respect to a line that is a swing center shaft of the case, wherein the two push switches in one of the pairs at one side have different operation forces;

two driving bodies, made of an inelastic material, disposed in contact with each upper surface of one pair of push switches located in parallel to the swing center shaft of the case; and a cover allowing the two driving bodies to be housed in and fixed to the case and having windows from which upper parts of the two driving bodies protrude;

wherein when the operation body is tilted in one direction, an upper surface position of the driving body that is a center between the one pair of push switches at a lower side in the tilting direction is pressed and the one pair of push switches operate by different operation forces.

2. The composite switch of claim 1, wherein the two pairs of push switches have a circular shape and are disposed in a manner in which they are displaced from each other in a range of the one pair of push switches in a direction parallel to the swing center shaft of the case.

3. The composite switch of claim 1, wherein the two pairs of push switches are operated by a same operation force and a contact position of the operation body pressing an upper surface of the driving body at the time of tilting operation is a position displaced from the center between the pair of push switches at a lower side in the tilting direction.

4. The composite switch of claim 1, wherein a portion that is brought into contact with the driving body at the time of tilting of the operation body has a spherical protruding shape.

5. The composite switch of claim 1, wherein the operation body is always brought into contact with the two driving bodies in a normal state in which the operation body is not tilted.

* * * * *